US005588570A

United States Patent [19]

Zirbel

[11] Patent Number: 5,588,570

[45] Date of Patent: Dec. 31, 1996

[54] COMBINATION BACKPACK AND SEAT DEVICE

[76] Inventor: Kurt D. Zirbel, 1715 S. Delaware, Mason City, Iowa 50401

[21] Appl. No.: 365,086

[22] Filed: Dec. 28, 1994

[51] Int. Cl.[6] ..... A45F 4/02

[52] U.S. Cl. ..... 224/155; 224/644; 297/129

[58] Field of Search ..... 224/155, 151, 224/153, 210, 212, 213, 261, 907, 156, 154, 642, 643, 644; 297/129, 16.1, 16.2, 31, 55

[56] References Cited

U.S. PATENT DOCUMENTS

| | | | |
|---|---|---|---|
| 3,307,758 | 3/1967 | Platt | 224/155 |
| 3,315,856 | 4/1967 | Black | 224/155 |
| 3,662,056 | 11/1971 | Droeger | 224/644 |
| 3,889,859 | 6/1975 | Joseph | 224/212 |
| 4,577,901 | 3/1986 | Phillips | 224/155 |
| 4,593,841 | 6/1986 | Lange | 224/153 |
| 4,694,979 | 9/1987 | Ables | 224/151 |
| 4,720,029 | 1/1988 | Varanakis | 224/155 |
| 4,738,383 | 4/1988 | Dearborne et al. | 224/156 |
| 4,773,574 | 9/1988 | Burgard | 224/155 |
| 4,889,383 | 12/1989 | Jones | 297/16.1 |
| 4,925,064 | 5/1990 | Comora | 224/155 |
| 4,955,517 | 9/1990 | Maresca | 224/155 |
| 5,016,792 | 5/1991 | Jay | 224/155 |
| 5,087,095 | 2/1992 | McFate | 297/129 |
| 5,209,381 | 5/1993 | Jay | 224/155 |
| 5,289,958 | 3/1994 | Jay | 224/155 |
| 5,303,975 | 4/1994 | Asato | 297/129 |
| 5,381,941 | 1/1995 | Brune | 224/155 |
| 5,409,291 | 4/1995 | Lamb et al. | 224/155 |

FOREIGN PATENT DOCUMENTS

| | | | |
|---|---|---|---|
| 2038986 | 9/1992 | Canada | 224/155 |
| 303513 | 2/1989 | European Pat. Off. | 224/213 |
| 6-237811 | 8/1994 | Japan | 224/153 |
| 1469054 | 3/1977 | United Kingdom | 297/129 |

*Primary Examiner*—David J. Walczak
*Assistant Examiner*—Gregory M. Vidovich
*Attorney, Agent, or Firm*—Zarley, McKee, Thomte, Voorhees, & Sease

[57] ABSTRACT

A combination backpack and seat device is provided which includes a frame separable into two members. The first member generally supports the backpack of the present invention and also provides a back rest for a seated user. The second member stores easily within the pouch of the backpack and can be attached to form an L-shaped structure. Once the second member of the frame is connected to the first member, a cushion can be lowered to form a low profile seat which can be used for sitting. The present invention allows for comfort and ease in assembly, as well as a lightweight unit which can be easily transported.

20 Claims, 2 Drawing Sheets

COMBINATION BACKPACK AND SEAT DEVICE

BACKGROUND OF THE INVENTION

The present invention relates to improvements in backpacks. More particularly, a backpack is provided with an integrated seat device which is simple and lightweight and permits conversion of a backpack which is capable of carrying necessary equipment to a low profile seat device suitable for a variety of functions including outdoor activities such as hunting.

A variety of outdoor activities require a user to sit for long periods of time and further require the user to transport various types of outdoor equipment. One common accessory of the outdoor sportsman is the backpack generally intended to assist the user in transporting various types of equipment, such as for recreational or sporting activities. Such a backpack should generally enable a wearer to carry a sizable load containing the needed equipment and supplies.

Although backpacks in the prior art are designed to carry needed equipment and supplies, it is necessary when undertaking certain outdoor activities to take the backpack off and either rest or wait for a certain event.

One such example of an outdoor activity which requires both the transport of equipment as well as prolonged seated activity is turkey hunting. A turkey hunter is often required to hike several miles in order to find the proper location and then is required to sit for prolonged periods of time without undue movement until his quarry becomes visible. Further, because of the intelligence and excellent eyesight of the turkey, it is doubly important that the hunter remain as motionless as possible in order to not alert the bird to the hunter's presence.

As a result, there is a definite need in the art for an improved combination backpack and seat device which allows a user to carry needed supplies and equipment on his or her back in comfort for prolonged periods of time which can be converted to a comfortable yet sturdy seating device. The overall apparatus needs to be lightweight and sturdy, allow for easy and quick assembly, and provide comfort for a seated user over a prolonged period of time.

SUMMARY OF THE INVENTION

The combination backpack and seat device of the present invention includes a pouch which is supported on an upper frame which is constructed of a lightweight yet rigid material. A removable base portion of the frame can be stored in the pouch and can easily be removed from the pouch and attached to the main frame of the backpack to support the backpack in an upright position. A cushion is secured to the side of the frame opposite the pouch and is pivotal between a first transport position and a second sitting position. The cushion in the transport position provides padding between the user's back and items in the pouch. When the cushion is placed in the sitting position, the resulting device becomes a ground level seat. When the device is used as a backpack, the base frame portion of the frame is removed from the upright frame and stored within the pouch.

It is a principle objective of the present invention to provide a combination backpack and seat device which is capable of transporting equipment and supplies and which can be quickly and easily converted into a seating device.

It is another objective of the invention to provide a combination backpack and seat device which is lightweight and rigid and which can function comfortably as a backpack and seating device.

It is another objective of the invention to provide a combination backpack and seat device which can be converted from a backpack to a seating device by attachment of a single frame member to the upper backpack frame.

It is another objective of the present invention to provide a combination backpack and seat device which comprises a cushion moveable between a raised transport position and a lowered seating position which provides comfort in both positions to the device user.

It is another objective of the present invention to provide a combination backpack and seat device which can be quickly converted between its backpack function and its low level seat function.

Yet another objective of the present invention is the provision of a combination backpack and seat device which is easy to use, economical to manufacture, long lasting, and trouble free in operation.

These objectives, together with other objectives and advantages, will become apparent from the following description and drawings and from the claims.

DETAILED DESCRIPTION OF THE PREFERRED EMBODIMENT

Figure 2:
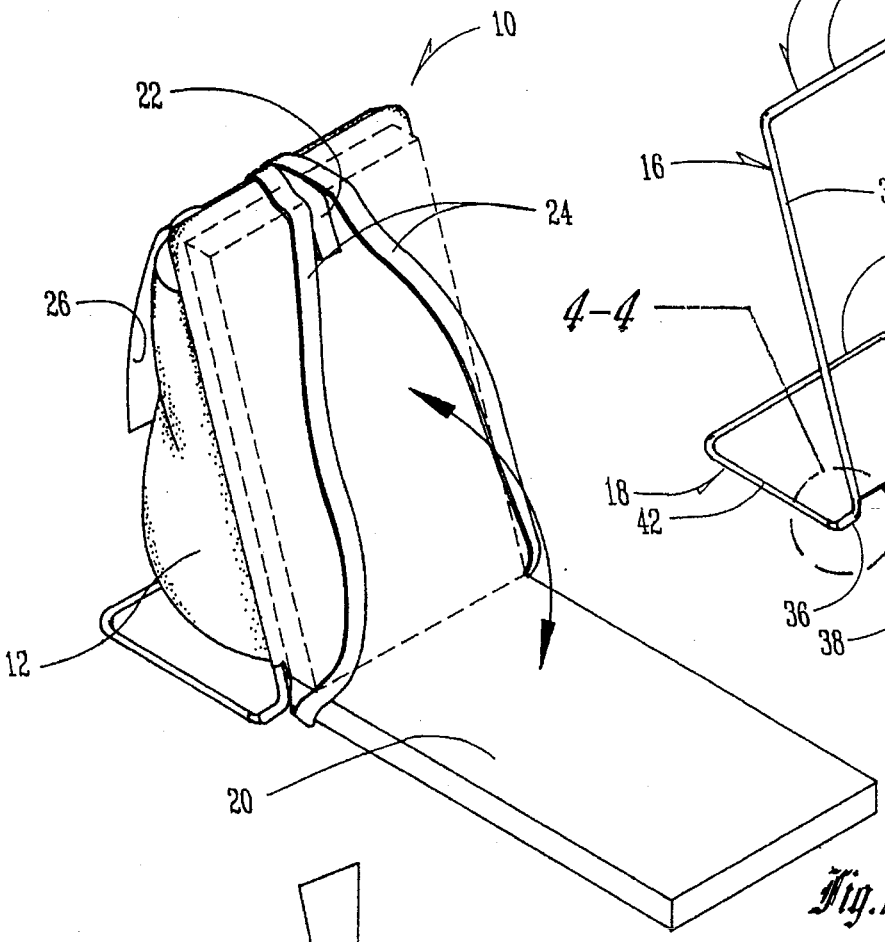
FIG. 2 is a perspective view of the preferred embodiment of the present invention, and showing the cushion in the lowered position in solid lines, and the raised position in broken lines.

Referring to the drawings, the numeral 10 general designates a combination backpack and seat device constructed in accordance with the present invention. Device 10 includes a pouch 12 which is supported by a frame 14. The frame 14 is comprised of two sections, an upper frame portion 16 which supports the pouch 12, and a lower frame portion 18 or base which is removably mounted to the upper frame portion 16 and storable within the pouch 12. A cushion 20 is mounted on the device 10 and supported for movement between a first raised position, or transport position, shown by the dotted lines in FIG. 2, and a second lowered position shown by solid lines in FIG. 2. The cushion 20 is held in the first transport position by a Velcro strap 22.

Figure 1:
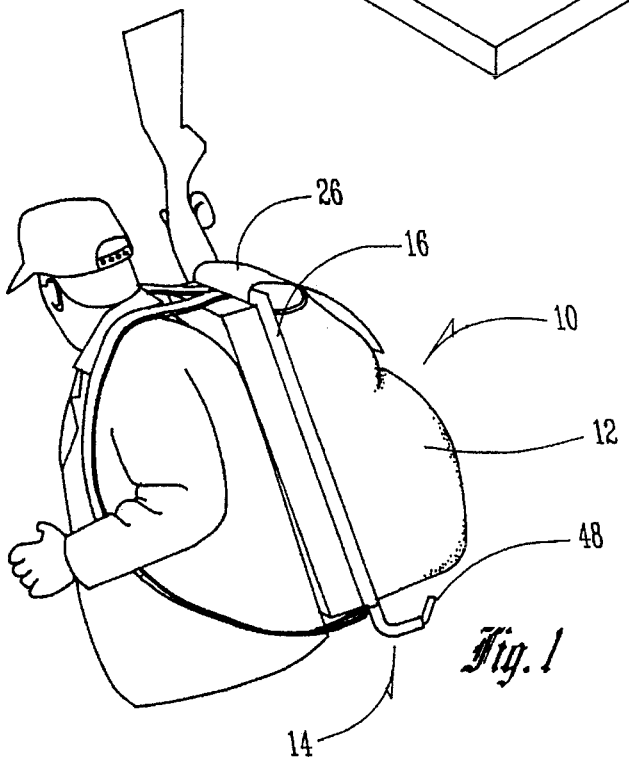
FIG. 1 is a side perspective view of the user and combination backpack and seat device as seen from the left side of the user.

When the cushion 20 is in transport position and held in place by the strap 22, a user can carry the backpack by operatively engaging a pair of shoulder straps 24, as shown in FIG. 1. Articles carried in the pouch 12 can further be covered and protected by a flap 26.

Figure 3:
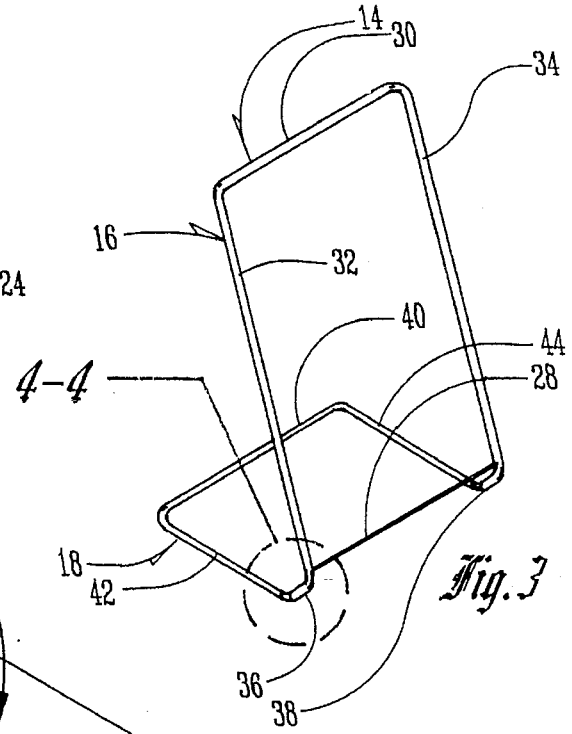
FIG. 3 is a perspective view of the assembled frame of the present invention.

As best shown in FIG. 3, the upper portion 16 of the frame 14 is substantially U-shaped with a cross member 28 providing additional structural support. The upper frame portion 16 of the frame 14 is comprised of a transverse member 30 and upright members 32, 34. Each vertical member 32, 34 terminates in a lower curved section 36, 38 which extends rearwardly away from the user as shown in FIG. 1.

The lower base portion 18 of the frame 14 is also generally U-shaped and includes a transverse member 40 and two substantially parallel support arms 42, 44.

Figures 4, 5, 6, 7:
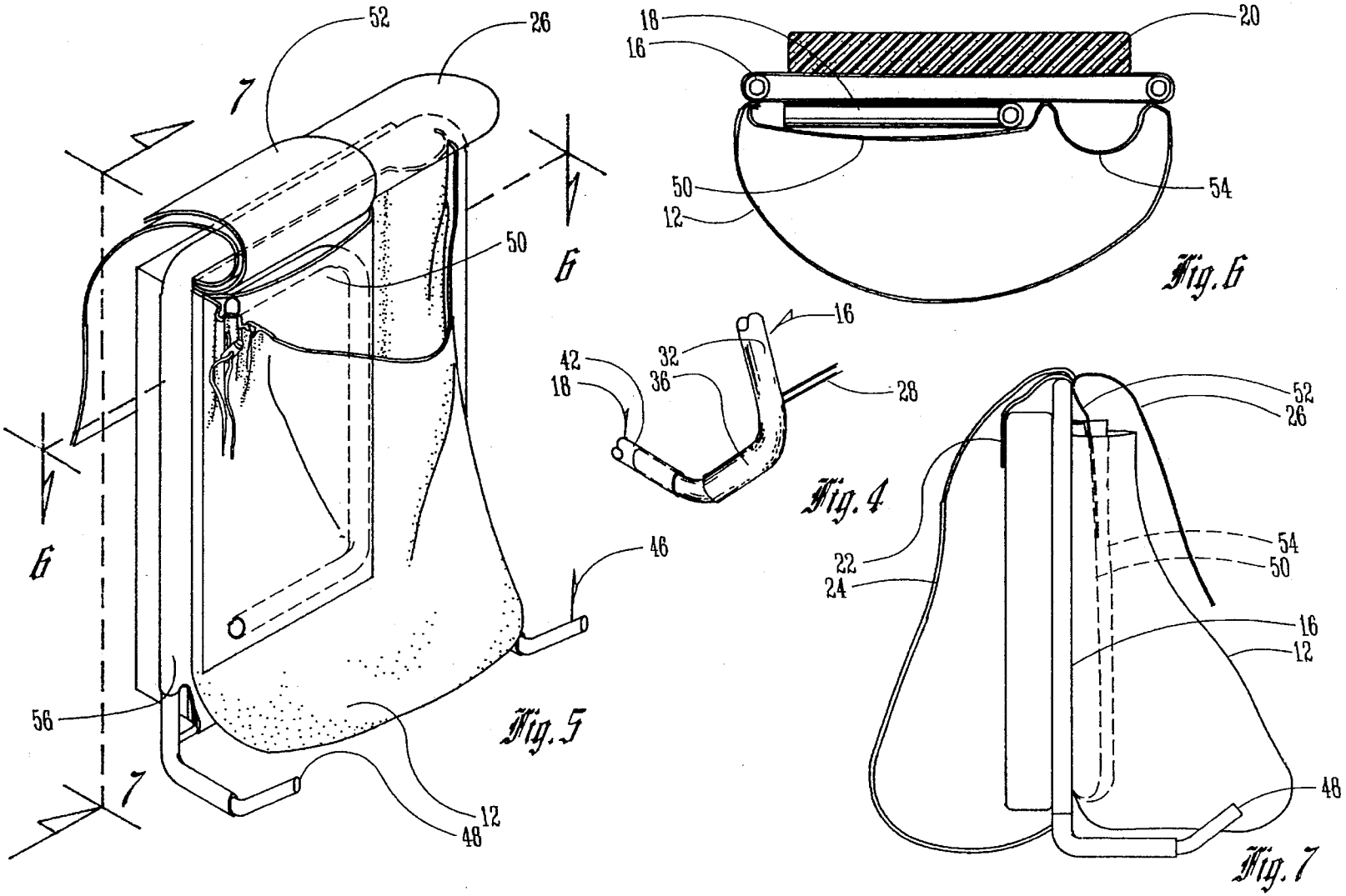
FIG. 4 is an enlarged perspective view taken along line 4—4 of FIG. 3.
FIG. 5 is a perspective view of the present invention showing the internal storage location for the lower base frame portion.
FIG. 6 is a sectional view taken along lines 6—6 of FIG. 5.
FIG. 7 is a sectional view taken along lines 7—7 of FIG. 5.

As best shown in FIG. 4, the curved portions 36, 38 of the upper frame 16 engage the support arms 42, 44 of lower portion 18, respectively. A longitudinal bore in each support arm 42, 44 serves as a female connector which accepts a matingly shaped male extension 46, 48 of the curved portions 36, 38 of the upper frame 16. These male extensions 46, 48 are best displayed in FIG. 5. Therefore, the lower portion 18 and upper portion 16 are slidably engaged to form a generally L-shaped support base. The angle between the lower frame portion 18 and the upper frame portion 16 is generally acute so as to allow a slightly reclined seating position by a user.

As best shown in FIG. 5, when not slidably connected to the upper frame portion 16, the lower portion 18 is placed within a separate pocket 50 within the pouch 12. The pocket 50 also includes flap 52 which allows a user to seal the lower frame portion 18 within the pocket 50 and prevent contact of this lower frame portion 18 with the contents of pouch 12. The pouch 12 can also include a variety of other pockets, pouches, or dividers, an example of which is the gun sling 54 best shown in FIG. 6.

For additional support and added comfort, a fabric webbing 56 extends between the upright members 32, 34, and between the support member 28 and transverse member 30 of upper frame 16. The cushion 20 is hingeably connected to the device 10 and, in its operable position, provides a seat cushion for a user in a seated position. In its operable position, the fabric webbing 56 provides support for a user's back and may be further padded to provide additional comfort.

In operation, a user places the cushion 20 in the closed or transport position, fills the pouch 12 with equipment and other articles for transport, the lower base portion 18 of frame 14 in the pocket 50 within pouch 12, and straps the device 10 to his back, as shown in FIG. 1, by putting the shoulder straps 24 around his or her shoulders. The cushion 20 provides padding between the user's back and the items in the pouch 12. If desired, the lower portion 18 of the frame can be maintained on the upper portion 16 of the frame, so as to support the pouch in a substantially upright position for packing, and then removing the lower portion 18 and inserting the lower portion 18 into the pocket 50 after the pouch is packed.

When the user desires to sit down, the device 10 is removed from the user and placed on the ground, the user lifts flap 26 of pouch 12 and the flap 52 of the pocket 50 and removes the lower frame member 18. The user then slidably engages lower frame member 18 onto male extensions 46, 48 of the upper portion 16 of frame 14, thereby creating a back rest for the seat. The seat is formed when the cushion 20 is lowered into its second position, as shown in FIG. 2, and a back rest is provided by the fabric webbing 52.

The frame 14 is constructed of a light-weight yet rigid material which does have some flex so as to provide a spring-like or biasing action when the frame portions 16 and 18 as assembled, thereby increases the comfort of the user.

In addition, if device 10 is used by a hunter, the device 10 helps absorb recoil from shooting a rifle or shotgun. The device 10 sets up with or without the aid of a tree or solid object. The pouch 12 is large enough to carry all necessary equipment and may, of course, be altered for individual purposes. The cushion 12 can be made extra long and waterproof for adverse conditions.

The device 10 sets up quickly and quietly and puts a hunter in a good natural seated shooting position, thereby allowing the hunter to await the animal without movement which may alert the animal. The low profile of the device 10 is excellent for use with blinds and other outdoor shelter. The external fabric of the cushion 12 and webbing 56 can be made of a waterproof material which is easily cleaned due to its continual contact with the elements and the ground.

The shoulder straps 24 are adjustable for different sized users and different loads, and the external coloring of device 10 can be colored for safety (blaze orange), camouflage, or aesthetics, depending on a user's preference.

The foregoing is considered as illustrative only of the principles of the invention. Since numerous modifications and changes will readily occur to those skilled in the art, it is not desired to limit the invention to the exact construction or operation shown and described, and accordingly, all suitable modifications and equivalents may be resorted to which fall within the scope of the invention as set forth in the following claims.

What is claimed is:

1. A combination backpacking and seating device, comprising:

a frame having an upper frame member with forward and rearward sides and opposite top and bottom ends, and a lower frame member extending rearwardly from the upper frame member adapted to support the upper frame member in an upright position on a support surface;

a cushion having a top end and a bottom end, the bottom end of the cushion being attached to the bottom end of the upper frame member and the top end of the cushion being movable between a raised position adjacent the forward side of the upper frame member and a lowered position extending forwardly from the bottom end of the upper frame member, the cushion engaging the support surface when moved to the lowered position and the lower frame member is positioned on the support surface;

a storage pouch attached to the upper frame member and residing on the rearward side thereof; and shoulder straps attached to the upper frame member;

wherein the cushion provides a back pad for a user when in the raised position and wherein the cushion provides a seat pad for the user when moved to the lowered position.

2. The device of claim 1 wherein the upper frame member is substantially U-shaped with opposite legs and an interconnecting web extending between the opposite legs of the upper frame member, and the lower frame member is substantially U-shaped with opposite legs and an interconnecting web extending between the opposite legs of the lower frame member, the opposite legs of the upper frame member being detachably connected to the opposite legs of the lower frame member, respectively.

3. The device of claim 2 wherein the legs of one of the upper and lower frame members have male ends and the legs of the other of the upper and lower frame members have female ends for matingly receiving the male ends of the one frame member.

4. The device of claim 1 wherein the storage pouch includes a compartment for storing the lower frame member.

5. The device of claim 1 wherein the cushion is pivotally attached to the upper frame member for pivotal movement between the raised and lowered positions.

6. The device of claim 1 further including a fastener to secure the cushion in the raised position.

7. The device of claim 1 wherein the frame forms a continuous closed loop.

8. The device of claim 1 wherein the frame is free from pivotal joints.

9. The device of claim 1 further including a closure flap for covering the storage pouch.

10. The device of claim 1 wherein the storage pouch has a plurality of compartments.

11. The device of claim 1 wherein the interconnected upper and lower frame members are resilient.

12. The combination backpacking and seating device of claim 1 wherein the cushion is unsupported by the lower frame member.

13. The device of claim 1 wherein the cushion is connected to the upper frame member only adjacent the bottom end of the cushion when the cushion is in the lowered position.

14. A backpacking and seating device, comprising:

first and second frame members forming a substantially rigid frame, the second frame member adapted to support the first frame member in an upright manner when the second frame member is positioned on a support surface;

shoulder straps attached to the first frame member;

a cushion pivotally attached to the first frame member and free from the second frame member, the cushion being pivotal between a first back padding position between the first frame and shoulder straps and a second seat padding position extending forwardly from the rigid frame, wherein the cushion has opposite upper and lower sides, the upper side being adjacent the first frame member when the cushion is in the first position, and the lower side engaging the support surface when the cushion is in the second position; and a pouch attached to the first frame member opposite the cushion for storing objects.

15. The device of claim 14 wherein the frame has resiliency.

16. The device of claim 14 wherein the second frame member is detachable from the first frame member and is storable in the pouch.

17. The device of claim 16 wherein the first and second frame members have matingly engageable terminal ends.

18. The device of claim 16 wherein the assembled frame members form a substantially L-shaped structure.

19. A method of converting a backpack to a back supporting seating device, the backpack having shoulder straps connected to an upper frame member with a cushion and a storage pouch secured to the frame member, the method comprising:

placing the lower frame member on a support surface so as to support the upper frame member in an upright position;

moving the cushion from a position between the shoulder straps and the upper frame portion to a position on the support surface, whereby a user can sit upon the cushion and lean his/her back against the upright upper frame member.

20. The method of converting a backpack to a back supporting seating device in claim 19 wherein the cushion has a top end and a bottom end, the bottom end hingeably mounted to the upper frame member.

* * * * *